United States Patent [19]

Hardy et al.

[11] 4,238,373

[45] Dec. 9, 1980

[54] PROCESS FOR MAKING DETERGENT COMPOSITIONS CONTAINING NITROGENOUS CATIONIC SURFACTANTS

[75] Inventors: Frederick E. Hardy, Newcastle upon Tyne; Brian E. Talkes, Morpeth, both of England

[73] Assignee: The Procter & Gamble Company, Cincinnati, Ohio

[21] Appl. No.: 17,209

[22] Filed: Mar. 5, 1979

[30] Foreign Application Priority Data

Mar. 6, 1978 [GB] United Kingdom ..... 8778/78
Mar. 7, 1978 [GB] United Kingdom ..... 8989/78

[51] Int. Cl.[3] ..... C11D 1/62; C11D 1/835

[52] U.S. Cl. ..... 252/542; 252/547; 564/282; 564/291; 564/292; 564/296

[58] Field of Search ..... 252/8.8, 8.9, 524, 528, 252/542, 547, 501.15, 567.5 M, 404, 404.5

[56] References Cited

U.S. PATENT DOCUMENTS

| | | | |
|---|---|---|---|
| 2,357,598 | 9/1944 | Mauersberger | 260/404.5 |
| 3,113,956 | 12/1963 | Robinette | 260/567.6 X |
| 3,401,119 | 9/1968 | Froehlich | 252/117 |
| 3,428,682 | 2/1969 | Egan et al. | 260/567.6 |
| 3,664,952 | 5/1972 | Maske | 252/8.75 |
| 3,819,539 | 6/1974 | Bloch et al. | 252/547 |
| 3,951,879 | 4/1976 | Wixon | 252/547 |
| 3,959,157 | 5/1976 | Inamorato | 252/8.8 |
| 4,136,054 | 1/1979 | Petzold et al. | 252/302.21 |

*Primary Examiner*—P. E. Willis, Jr.

[57] ABSTRACT

A process for quaternization of tertiary amines in a reaction medium comprising a water soluble or water dispersible organic compound of MWt>240 which is liquid at the quaternization reaction temperature, one of the quaternization reactants having a BPt<200° C. and being volatile relative to the other reactants, to permit its removal after the completion of quaternization to leave a product comprising an intimate mixture of a cationic surfactant and the reaction medium in a weight ratio of 2:1 to 1:50. Preferably the reaction medium is an ethoxylated nonionic surfactant.

13 Claims, No Drawings

PROCESS FOR MAKING DETERGENT COMPOSITIONS CONTAINING NITROGENOUS CATIONIC SURFACTANTS

FIELD OF THE INVENTION

This invention relates to the preparation of mixture of cationic nitrogen-based surfactants, especially quaternary ammonium surfactants with certain water-soluble or water dispersible organic compounds.

BACKGROUND OF THE INVENTION

The preparation of cationic nitrogen-based surfactants involves the reaction of a tertiary amine with a quaternising agent in order to impart a positive charge to the nitrogen atom. This reaction can be carried out in a variety of solvents which may be aqueous or anhydrous, but a lower aliphatic alcohol-water mixture is normally employed commercially. Excess quaternising agent is removed from the reaction product by evaporation, after which the cationic surfactant may be purified in one or more work-up stages, to remove unreacted starting material or by-products and to improve product colour.

Nevertheless, separation and purification of the cationic surfactant is difficult and expensive, and, indeed, certain cationic surfactants form solids which cannot easily be handled in this way. This may be because the hydrophobic portions of the molecule contain a range of hydrocarbon chain lengths which may have different points of substitution or because the molecule contains groups such as hydroxy alkyl groups which are very difficult to produce as crystalline solids. This difficulty is compounded by the tenacity with which these materials retain solvents such as lower aliphatic alcohols and water so that the production of such cationic surfactants in solid form is unattractive commercially.

For this reason most cationic surfactants are offered commercially as solutions or dispersions in water or in a lower aliphatic alcohol-water mixture such as for example isopropanol-water, this being the solvent medium in which the quaternisation is carried out. This imposes certain formulation constraints where a solid cationic surfactant is required or where the presence of a volatile solvent is undesirable, e.g. in product whose physical form is not liquid and/or where the processing of such products would be adversely affected by the presence of a solvent.

It has now been found that this difficulty can be overcome by carrying out the preparation of cationic surfactants in an organic medium which is itself a component of the final product, but which is liquid under the conditions employed for quaternisation. One advantage of this procedure is that it permits the formation of the desired cationic surfactant as a finely divided dispersion, or in some cases a solution in the other product component, without the need to use solvents which require recovery or disposal. A further advantage is that it avoids the necessity of isolating and separately adding the cationic surfactant to the product, further simplifying its incorporation. Additionally, as described hereafter, the procedure offers an inexpensive and commercially attractive route to the manufacture of certain highly preferred cationic surfactant materials.

SUMMARY OF THE INVENTION

According to the present invention, there is provided a process for producing an intimate mixture of a nitrogen-based cationic surfactant and a water soluble or water dispersible organic compound having a molecular weight greater than 240 comprising the steps of (a) quaternising a tertiary amine to form a cationic surfactant in a liquid reaction medium comprising a water soluble or water dispersible organic compound having a molecular weight greater than 240, one of the quaternisation reactants being volatile relative to the other reactant or reactants and having a Boiling Point at atmospheric pressure of less than 200° C., said volatile reactant being present in excess over that required stoichiometrically, (b) treating the cationic surfactant-reaction medium mixture at a temperature of not more than 200° C. to remove any unreacted volatile reactant and leave an intimate mixture wherein the ratio of organic reaction medium to cationic surfactant lies in the range of 50:1 to 1:2 by weight.

Preferably the reaction medium comprises an organic polyethenoxy condensate and preferably also the reaction is carried out under substantially anhydrous conditions. In a particularly preferred embodiment the reaction is carried out at a temperature not greater than 50° C.

In a highly preferred embodiment of the invention in which the cationic surfactant is prepared in an ethoxylated nonionic surfactant reaction medium, the cationic surfactant is a quaternary ammonium salt containing a $C_{12}$–$C_{14}$ alkyl group attached to the nitrogen atom, the remaining groups on the nitrogen atom being selected from $C_1$–$C_4$ alkyl and hydroxy alkyl radicals, the counter ion being selected from halide, methosulphate and carboxylate ions, and the nonionic surfactant reaction medium is a primary $C_{14}$–$C_{15}$ aliphatic alcohol condensed with from 7 to 15 moles of ethylene oxide per mole of alcohol.

DETAILED DESCRIPTION OF THE INVENTION

The present invention concerns the formation of a mixture of a cationic surfactant and a water soluble or water dispersible organic compound having a molecular weight greater than 240, the latter being used as a liquid reaction medium for the quaternisation of a tertiary amine to produce the former.

(a) The Tertiary Amine

The process of the present invention is applicable to the quaternisation of a wide range of tertiary amines. An exemplary class of amines has the structure:

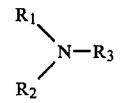

wherein $R_1$ is an organic group containing from 1 to 22 carbon atoms and normally incorporating a straight or branched chain $C_8$–$C_{22}$ alkyl or alkenyl group or a $C_{10}$–$C_{16}$ alkylbenzyl group. The $C_8$–$C_{22}$ alkyl or alkenyl group can be substituted with up to 3 phenyl groups and may also be interrupted by up to four structures selected from the group consisting of:

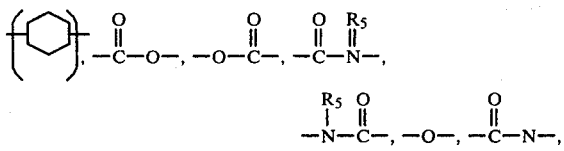

wherein $R_5$ is selected from hydrogen, $C_1$–$C_4$ alkyl, $C_1$–$C_4$ hydroxyalkyl and benzyl. The $R_1$ group may include mixtures of the foregoing substituents and may additionally contain up to 20 ethoxy groups. $R_2$ and $R_3$ can be the same as $R_1$ or can independently be selected from substituted or unsubstituted $C_1$–$C_4$ alkyl groups, or benzyl, provided that an amine molecule contains not more than one such benzyl group attached directly to a nitrogen atom. Preferred substituents in the $C_1$–$C_4$ alkyl groups of $R_2$ and $R_3$ are hydroxy groups.

Examples of this type of tertiary amine include dodecyl dimethyl amine, $C_{12}$–$C_{14}$ alkyl diethanolamine wherein the $C_{12}$–$C_{14}$ alkyl groups are derived from middle cut coconut alcohol or from petroleum hydrocarbon fractions, distearyl methyl amine, myristyl methyl ethanolamine, cetyl diethylamine, dodecylbenzyl dimethyl amine and myristyl methyl benzyl amine.

A further class of tertiary amines is that having the structure:

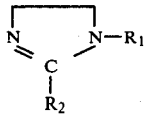

wherein $R_1$ and $R_2$ are as hereinbefore defined. Examples of amines of this class are those in which $R_1$ is

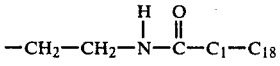

alkyl and $R_2$ is $C_1$–$C_{22}$ alkyl and especially those in which the alkyl groups are derived from animal and vegetable fat-stocks such as coconut oil and tallow.

A third class of tertiary amines is comprised by pyridine and its analogues, viz.:

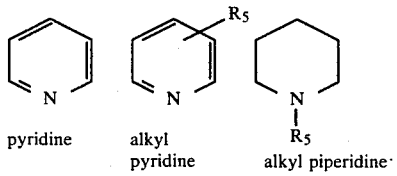

wherein $R_5$ is ethyl or methyl and by analogues of pyrrole viz:

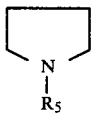

Typical examples of this class are pyridine, picoline (methylpyridine), methyl piperidine, and methyl pyrrolidine.

Particularly preferred tertiary amines for use in the process of the present invention are $C_{12}$–$C_{14}$ alkyl dimethyl amine in which the alkyl chain is derived from coconut alcohol or from Ziegler olefins, alkylbenzyl dimethyl amine in which the alkyl group contains from 10 to 14 carbon atoms and di $C_{16}$–$C_{18}$ alkyl methyl amine in which the alkyl group is derived from animal or vegetable fats.

(b) The Quaternising Agent

The other component of the reaction is a quaternising agent which is normally an organic halide, methosulphate, toluene sulphonate or phosphate, or an epoxide. A requirement of the present invention is that one of the reactants shall be volatile relative to the other and shall have a Boiling Point at atmospheric pressure of less than 200° C., and the most common quaternising agents fit into this catagory. It is also convenient for this component to be used in excess of that required for stoichiometric conversion of the other component to form the cationic surfactant, usages of up to 4.0 molar excess being feasible. However, usages of less than 1.0 molar excess, preferably about 5–10% molar excess are normally sufficient to force the reaction to completion. Thereafter the unreacted excess is removed by evaporation which may take place at atomspheric pressure or under vacuum.

Typical quaternising agents are the methyl, ethyl, n-propyl and n-butyl halides, particularly the bromides and chlorides. Dimethyl and Diethyl sulphate can also be employed and allyl chloride is an example of an organic group other than alkyl. An alternative combination of reactants can be provided by the reaction of a long chain length organic halide with a short chain tertiary amine, typical examples of the halide being a $C_{12}$–$C_{14}$ alkyl bromide or a $C_{10}$–$C_{18}$ alkyl benzyl chloride. In this combination the tertiary amine would be the volatile component present in excess which would be removed by evaporation following completion of the reaction. Examples of such tertiary amines are $C_1$–$C_4$ alkyl dimethylamines, $C_1$–$C_2$ diethylamines and 1-methyl-3-pyrroline.

Preferably the boiling point of the quaternising agent at atmospheric pressure is less than 100° C. as this requires less heating of the reaction mixture and also reduces or eliminates the need for vacuum treatment in order to remove all traces of unreacted quaternising agent. The most preferred quaternising agents in this respect are those which are gases under ambient conditions, e.g. methyl and ethyl chloride, methyl bromide and ethylene oxide. In a highly preferred embodiment of the invention, the quaternisation is carried out with $C_2$–$C_4$ alkylene oxide, preferably ethylene or propylene oxide. This embodiment requires the presence of an acid, which provides a source of hydrogen ion to promote the desired reaction and also provides the counter ion for the cationic surfactant. Suitable acids for this purpose are the halo acids, sulphuric and nitric acids, oxalic acid, $C_1$–$C_{20}$ aliphatic carboxylic acids, benzoic acid and benzene, toluene, xylene and cumene sulphonic acids. Suitable carboxylic acids for the purposes of the present invention are the long chain (i.e. $C_{12}$–$C_{20}$) aliphatic carboxylic acids, particularly the $C_{12}$–$C_{18}$ fatty acids.

(c) The Organic Reaction Medium

The organic reaction medium is a water soluble or water dispersible organic compound, of MWt greater than 240, which is in a liquid phase at a temperature at which the quaternisation can be carried out without excessive discolouration or decomposition on the reactants. Preferably the reaction medium has a melting point less than 100° C., desirably less than 50° C., and most preferably it has a softening point within the range 30° C.-40° C. It is preferable, although not absolutely essential, that the organic reaction medium have some degree of polarity in order to assist the quaternisation reaction. This is particularly desirable if an epoxide is used as the quaternising agent and for this reason hydroxy group-containing compounds are preferred for quaternisation reactions involving an epoxide. Suitable compounds include the higher fatty alcohols i.e. those having an average of at least 16 carbon atoms, $C_{10}$–$C_{18}$ alkyl alkanolamides and polyethylene oxide condensates, particularly those having a molecular weight greater than 300.

Suitable polyethylene oxide condensate compounds are the polyethylene glycols of molecular weight 400–20,000 particularly those having a molecular weight from 2,000 to 20,000. Also suitable are the nonionic surfactant polyethylene oxide condensates such as ethoxylated $C_{10}$–$C_{20}$ alcohols, $C_{10}$–$C_{18}$ fatty acids, $C_6$–$C_{12}$ alkyl phenols, $C_{10}$–$C_{18}$ aliphatic and heterocyclic esters and $C_{10}$–$C_{22}$ fatty acid amides.

Suitable nonionic surfactants based on aliphatic alcohols are condensation products of primary and secondary alcohols with from 4 to about 30 moles of ethylene oxide. The alkyl chain of the aliphatic alcohol can either be straight or branched and generally contains from about 8 to about 22 carbon atoms. Examples of such ethoxylated alcohols include the condensation product of myristyl alcohol with about 10 moles of ethylene oxide per mole of alcohol and the condensation product of about 9 moles of ethylene oxide with coconut alcohol (a mixture of fatty alcohols with alkyl chains varying in length from 10 to 14 carbon atoms). Examples of commercially available nonionic surfactants of this type include Tergitol 15-S-9, marketed by Union Carbide Corporation, Neodol 45E9, marketed by Shell Chemical Company, and Kyro EO marketed by The Procter & Gamble Company. Other suitable alcohol ethoxylates include:

| | |
|---|---|
| Tallow | ($C_{16}$–$C_{18}$) alcohol ($E_{25}$) |
| Linear | ($C_{14}$–$C_{15}$) alcohol ($E_5$) |
| | ($C_{14}$–$C_{15}$) alcohol ($E_7$) |
| | ($C_{12}$–$C_{13}$) alcohol ($E_6$) |
| | ($C_9C_{11}$) alcohol ($E_5$) |
| Branched | ($C_{10}$–$C_{13}$) alcohol ($E_4$) |
| Linear | (s-$C_{11}$–$C_{15}$) alcohol ($E_5$) |
| | (s-$C_{11}$–$C_{15}$) alcohol ($E_7$) |
| | (s-$C_{11}$–$C_{15}$) alcohol ($E_9$) |

Alcohol ethoxylates such as those disclosed in British Pat. Specification No. 1,462,134, incorporated herein by reference, are also useful in the present invention.

Suitable alkyl phenol ethoxylates include the condensation products of alkyl phenols having an alkyl group containing from about 6 to about 12 carbon atoms in either a straight chain or branched chain configuration with ethylene oxide, said ethylene oxide being present in an amount equal to 8 to 20 moles of ethylene oxide per mole of alkyl phenol. The alkyl substituent in such compounds can be derived, for example, from polymerized propylene, di-isobutylene, and the like. Examples of compounds of this type include nonyl phenol condensed with about 9.5 moles of ethylene oxide per mole of nonyl phenol; dodecylphenol condensed with about 12 moles of ethylene oxide per mole of phenol, dinonyl phenol condensed with about 15 moles of ethylene oxide per mole of phenol; and di-isoctyl phenol condensed with abut 15 moles of ethylene oxide per mole of phenol. Commercially available nonionic surfactants of this type include Igepal CO-630, marketed by the GAF Corporation, and Triton X-45, X-114, X-100, and X-102, all marketed by the Rohm & Haas Company.

Other suitable phenol ethoxylates includes:

| | |
|---|---|
| Linear | $C_8$ Alkyl phenol ($E_5$) |
| | $C_8$ Alkyl phenol ($E_8$) |
| | $C_9$ Alkyl phenol ($E_6$) |
| | $C_9$ Alkyl phenol ($E_9$) |

Suitable fatty acid ethoxylates include coconut fatty acid ($E_5$) and oleic fatty acid ($E_{10}$), while ester ethoxylates include:

Sorbitan monooleate: ($E_5$)
Sorbitan trioleate: ($E_{20}$)
Sorbitan monostearate: ($E_4$)
Sorbitan tristearate: ($E_{20}$)

Other nonionic surfactants useful herein include the condensation products of ethylene oxide with the product resulting from the condensation of propylene oxide with propylene glycol. Surfactants of this type are available commercially from the Wyandotte Chemicals Corporation under the Trade name "Pluronic".

Particularly preferred materials are the primary linear and branched chain primary alcohol ethoxylates, such as $C_{14}$–$C_{15}$ linear alcohols condensed with 7–15 moles of ethylene oxide available from Shell Oil Co. under the "Neodol" and "Dobanol" Trade Marks and the $C_{10}$–$C_{13}$ branched chain alcohol ethoxylates obtainable from Liquichimica SA under the 'Lial' Trade Mark.

The quaternisation reaction is carried out using techniques well known in the art. The relatively nonvolatile quaternisation reaction component, normally a tertiary amine containing one or more long chain hydrocarbon residues, is mixed with the organic reaction medium, heating the latter if required, to give a mobile low viscosity liquid. A reaction temperature of not more than 100° C., preferably less than 50° C., is desirable in order to avoid colour body formation, although higher temperatures can be tolerated if an inert gas blanket is used. The mixture is agitated and the quaternising agent is then introduced in an amount in excess of that required stoichiometrically, refluxing the reaction mixture to retain the reactants. As mentioned hereinbefore, the most preferred quaternising agents are gases or low boiling liquids and these are conveniently added as precooled liquids to facilitate control of the reaction. In such circumstances a low temperature reflux system is also used, the most common coolant being acetone cooled by solid carbon dioxide.

As the reaction proceeds, the cationic surfactant normally appears as a solid dispersed in the reaction medium and the viscosity of the latter increases. This viscosity increase limits the concentration of cationic surfactant in a heterogeneous reaction mixture to a maximum of approximately 50% by weight, i.e. a weight ratio of reaction medium to cationic surfactant of 1:1. However, in certain embodiments of the invention, especially those in which the cationic surfactant has a melting point less than approximately 100° C., or where the counter ion is a long chain aliphatic carboxylate such as oleate or stearate and the reaction medium is an ethoxylated nonionic surfactant the reaction mixture is a mobile liquid at temperatures above 40° C. In such reaction systems the cationic surfactant concentration can reach 66% i.e. a reaction medium:cationic surfactant weight ratio of 1:2 although it is preferred that the reaction medium:cationic surfactant ratio should normally be greater than 2:3. Moreover it has been found that when using alkylene oxides as the quaternising agent, reaction temperatures in excess of 50° C. lead to excessive side reactions and thus it is highly desirable to keep the reaction temperature for such quaternisations below this value, preferably below approximately 45° C. This in turn imposes limitations on the concentration of cationic surfactant that can be handled in the reaction medium and thus for hydroxyalkylated cationic surfactants it is preferred that the weight ratio of reaction medium to quaternary surfactant be greater than 1:1.

The low limit of cationic surfactant concentration in the reaction medium is not dependent on the physical characteristics of the reaction mixture, but more on the accuracy with which the tertiary amine and quaternising agent components can be dispensed in the medium. A level of cationic surfactant of approximately 2% by weight in the reaction mixture (i.e. a reaction medium:-cationic surfactant ratio of 50:1) has been found to be a practicable minimum, with a preferred minimum level of 9% (i.e. a 10:1 ratio).

When the quaternisation is complete, the liquid mixture is treated to remove the excess relatively volatile component. For volatile components having boiling points from 50° C. to 200° C., the application of heat and also vacuum may be necessary to effect this removal together with agitation and perhaps inert gas sparging. In preferred embodiments of the reaction wherein the quaternising agent is a low boiling liquid or a gas at ambient temperatures, little or no heating of the mixture is necessary, but in all instances the mixture of reaction medium and cationic surfactant can be used without any further separation or crystallisation steps.

As previously mentioned, quaternisation reactions proceed under both anhydrous and aqueous conditions and the exclusion of water is not essential in the process of the present invention. However, one of the principal advantages of the process of the present invention is that it permits the formation of cationic surfactants without the need for work-up stages to remove solvents etc., which do not form part of the product in which the cationic surfactant is to be used.

The invention has been described in terms of the quaternisation of a tertiary amine to form a cationic surfactant but the invention also contemplates processes in which the tertiary amine is itself formed in situ in the reaction medium. An example of this would be the reaction of a primary amine with ethylene oxide to form a tertiary amine in the organic reaction medium followed by the reaction of the so-formed tertiary amine with a quaternising agent in accordance with the invention.

In reaction sequences in which an epoxidising agent is reacted with a primary or secondary amine to form a tertiary amine, it has been found necessary to include a low level of water in the reaction mixture to facilitate reaction at <70° C. A minimum of 2% water based on the weight of reaction medium is necessary and more preferably the level is between 5–10% by weight. Use of more than 10% water is feasible but is less attractive if there are constraints on the water content of the product in which the quaternised surfactant is to be used.

Mixtures made in accordance with the present invention are useful in their own right as a means of delivering a cationic surfactant in a variety of physical forms i.e. as a granule, chip, flake, noodle or agglomerate or as an adjunct to conventional granular detergents by dry mixing or spray on of the mixture as a molten liquid. Techniques for such physical manipulation or incorporation of mixtures made in accordance with the invention are well known to those skilled in the art and do not form part of the present invention.

Examples of nitrogen-based cationic surfactant-nonionic surfactant mixtures to which the process of the present invention can be applied are disclosed in Cockrell European Published Patent Application No. 78200064.0 and which is incorporated herein by reference.

Another nitrogen-based cationic surfactant system to which the process of the present invention can be applied is disclosed in Baskerville & Schiro U.S. Pat. No. 3,936,537 issued Feb. 3rd, 1976, and incorporated herein by reference. However, the mixture resulting from the process of the present invention is especially adapted as a source of cationic surfactant material in the sheet-type laundry additive product described in European Published Patent Application No. 78200051.7.

The invention is further illustrated in the following examples in which all percentages are on a weight basis unless otherwise stated.

EXAMPLE 1

28.37 g. of a substantially linear $C_{14-15}$ primary alcohol condensed with an average of seven moles of ethylene oxide per mole of alcohol and 8.82 g. (0.04 mole) of $C_{12}$–$C_{14}$ linear alkyl dimethyl amine (Alkyl chain length distribution 81% $C_{12}$ 14% $C_{14}$ 5% $>C_{16}$ Mean MWt. 220.4) were weighed into a reaction vessel fitted with a dropping funnel and a reflux condenser cooled by a solid $CO_2$-acetone mixture. The mixture was warmed to 27° C. on an oil bath using a magnetic stirrer to agitate the contents and at this temperature the amine was completely soluble in the ethoxylate. 4.2 g. methyl bromide (corresponding to 1.1 molar equivalents) was precooled to −20° C. and added via the dropping funnel to the reaction vessel. The reaction mixture became viscous, agitation was stopped and the mixture was held for 1½ hours under reflux to prevent loss of methyl bromide. Thereafter the mixture was liquefied by heating to approximately 45° C. and vacuum was applied to remove the last traces of methyl bromide following which it was then allowed to cool to 20° C. to give a white solid product. Pyrolytic GLC established the presence of a quaternary that was almost entirely $C_{12.5}N_{26}N^{+}(CH_3)_3Br^{-}$ and titration established the completeness of the quaternisation to be 93.2%. The product was found to comprise 28.75% cationic surfactant and 71.25% polyethoxylate. In a similar experiment carried out using 100% molar excess of methyl bromide a yield of 92.7% cationic surfactant was obtained in a product comprising 28.5% cationic surfactant and 71.5% polyethoxylate. The use of more than a 10% molar excess of quaternising agent, although feasible, is therefore unnecessary for the purposes of obtaining optimum completeness of reaction.

In the above experiment the methyl bromide is replaced by equimolar quantities of methyl chloride or allyl chloride and similar results are obtained. The same results are also obtained if the $C_{14}$–$C_{15}$ primary alcohol ethoxylate is replaced by nonyl phenol ($E_6$) secondary $C_{11}$–$C_{15}$ alcohol ($E_7$) or Polyethylene Glycol of MWt 10,000.

EXAMPLE 2

8.82 g. of $C_{12}$–$C_{14}$ linear alkyl dimethyl amine and 28.37 g. of a substantially linear $C_{14}$–$C_{15}$ primary alcohol condensed with an average of fifteen ethylene oxide groups per mole of alcohol were weighed into a reaction vessel, following the procedure of Example 1. The mixture was heated to 45° C. with agitation and 19.0 g. methyl bromide (precooled to −20° C.) was added, corresponding to a 4.0 molar excess. The mixture became viscous and the temperature was allowed to rise to 50° C. in order to permit agitation to be continued. After refluxing at 50° C. for three hours using a solid $CO_2$—acetone condenser the product was allowed to cool without the condenser in order to evaporate the excess methyl bromide.

Analysis of the product by GLC showed almost complete conversion of the tertiary amine to the quaternary ammonium bromide and cationic titration confirmed this, the completeness of the reaction being 94.0%. The resultant product contained 28.9% cationic surfactant and 71.1% nonionic ethoxylate.

In the above examples the methyl bromide can be replaced by equimolar amounts of methyl chloride or allyl chloride and equivalent results obtained. The $C_{12}$–$C_{14}$ alkyl dimethyl amine can also be replaced by an equimolar quantity of $C_{12}$–$C_{14}$ alkyl diethanolamine, myristyl methyl ethanolamine, dodecylbenzyl dimethyl amine, pyridine, methyl piperidine or myristyl methyl benzyl amine to give similar results.

EXAMPLE 3

14.22 g. (0.05 mole) of biochemical grade stearic acid, 11.02 g. (0.05 mole) $C_{12}$–$C_{14}$ alkyl dimethyl amine (MWt 220.4) and 45.25 g. of linear $C_{14}$–$C_{15}$ primary alcohol condensed with seven moles of ethylene oxide per mole of alcohol were weighed into a reaction vessel and heated to 45° C. following the procedure of Example 1. A clear solution was obtained. The mixture was agitated, cooled to 30° C. at which temperature the solution became cloudy and 6.6 g. of ethylene oxide (0.15 mole) precooled to −50° C., was added via a dropping funnel. The reaction mixture foamed and a white solid was formed which remained suspended in the reaction medium. Agitation was continued at a temperature of 30°–35° C. for 4 hours under a solid $CO_2$-acetone reflux condenser after which the reaction mixture was allowed to stand at room temperature to form a white waxy solid. Pyrolytic GLC analysis of the product showed the presence of a hydroxy ethyl group on the nitrogen atom and cationic titration established a completeness of $C_{12}$–$C_{14}$ alkyl dimethyl hydroxyethyl ammonium stearate formation of 85% corresponding to 32.2% of the mixture. This mixture also contained some alkyl dimethyl hydroxyethyl ammonium hydroxide which, upon addition of further stearic acid, reacted to give additional quaternary ammonium stearate so that the total conversion of amine starting material was approximately 94% and the quaternary ammonium stearate comprised 35.3% of the mixture, the remainder being the ethoxylated primary alcohol and trace amounts of stearic acid.

Similar results to the above are obtained if the stearic acid is replaced by an equimolar quantity to lauric or myristic acid or if the $C_{14}$–$C_{15}$ primary alcohol ($E_7$) ethoxylate is replaced e.g. $C_9$–$C_{11}$ (average $C_{10}$) primary alcohol ($E_8$), $C_{12}$–$C_{13}$ primary alcohol ($E_6$) Polyethylene Glycol of MWt 10,000 $C_{14}$ alkyl diethanolamide, or soribtan tri oleate ($E_{20}$).

EXAMPLE 4

44.09 g. of the $C_{12}$–$C_{14}$ alkyl dimethyl amine used in Example 1 and 100.31 g. of $C_{14}$–$C_{15}$ linear primary alcohol condensed with an average of seven ethylene oxide groups per mole of alcohol were weighed into a Dreschel bottle. The mixture was stirred and treated with anhydrous HCl gas (produced by an HCl generator) until approximately 7.3 g. HCl had been taken up. The treated mixture was purged with nitrogen until the outlet gases had a pH of 4.0 and analysis then showed that formation of the amine hydrochloride was 99.6% complete. The amine hydrochloride-alcohol ethoxylate mixture was transferred to an autoclave which was then sealed prior to the introduction of 23.52 g. of ethylene oxide this quantity representing a 2.0 molar excess over that required for stoichiometric conversion of the hydrochloride to the quaternary ammonium salt. The autoclave was then heated to 80° C. with shaking to agitate the contents and, after switching the heaters off, the temperature continued to rise to 90° C. and remained at a temperature >70° C. for 4 hours before cooling naturally over a 24 hour period to ambient temperature.

After venting the autoclave, the semisolid reaction product was removed, warmed and purged with nitrogen until a constant weight was reached. A weight increase of 4% over that due to the theoretical uptake of ethylene oxide was found and this is believed to be due to further condensation of the ethylene oxide with alcohol ethoxylate. Titration analysis of the product gave a level of 34.2% of $C_{12.5}$ alkyl dimethyl hydroxyethyl ammonium chloride, (Theoretical yield 35.6%) which is virtually quantitative given the weight increase of the reaction product.

EXAMPLE 5

500 g (1 g mole) of di(hydrogenated tallowyl) amine (Armeen 2HT) is mixed with 350 g Dobanol 45-7 and 80 g to 50% NaOH in a pressure vessel and 111.1 g Methyl chloride added to the mixture which is then maintained at a temperature of 64° C. over 18 hours. The sodium chloride formed in the reaction is subsequently removed by centrifugation and the quaternised product remaining has a reaction medium:quaternary ammonium salt weight ratio of 2:3.

We claim:

1. A process for producing an intimate solid mixture of a nitrogenous cationic surfactant and a water soluble or water dispersible organic component, comprising the steps of (a) reacting tertiary amine with quaternizing agent in liquid reaction medium consisting essentially of said organic component, one of said tertiary amine and said quaternizing agent reactants having a boiling point at atmospheric pressure equal to or less than 200° C. and being present in stoichiometric excess, said reaction being carried out at a temperature less than about 50° C. so as to form cationic surfactant in said liquid reaction medium while avoiding color body formation;

(b) treating the mixture resulting from step (a) at a temperature not greater than about 200° C. to remove unreacted portion of reactant used in excess to leave intimate mixture of organic component and cationic surfactant wherein the ratio of organic component to cationic surfactant lies in the range from about 50:1 to about 1:2 by weight;

(c) cooling to provide initimate solid mixture to cationic surfactant and organic component;

said tertiary amine having a structure selected from the group consisting of (i)

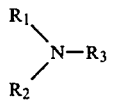

wherein $R_1$ is alkyl group containing from 1 to 22 carbon atoms and wherein $R_1$ may additionally contain up to 20 ethoxy groups and wherein each of $R_2$ and $R_3$ can be the same as $R_1$ or is independently selected from $C_1$–$C_4$ alkyl, $C_1$–$C_4$ hydroxyalkyl, and benzyl groups, no more than one group in a molecule being benzyl, and (ii)

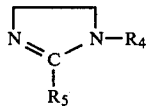

wherein $R_5$ is a $C_1$–$C_{20}$ alkyl group and $R_4$ has the formula

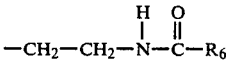

wherein $R_6$ is $C_1$–$C_{18}$ alkyl; said quaternizing agent being selected from the group consisting of $C_1$–$C_4$ alkyl halides, $C_2$–$C_4$ alkylene oxides, $C_{12}$–$C_{14}$ alkyl bromides, and $C_{10}$–$C_{18}$ alkyl benzyl chlorides; said organic component having a molecular weight greater than about 240 and being selected from the group consisting of (i) fatty alcohols containing an average of more than 16 carbon atoms, and (ii) polyethylene oxide condensates of $C_{10}$–$C_{20}$ alcohols, $C_{10}$–$C_{18}$ fatty acids, $C_6$–$C_{12}$ alkyl phenols, and $C_{10}$–$C_{18}$ fatty acid esters of sorbitan.

2. A process according to claim 1 wherein the weight ratio of reaction medium to cationic surfactant lies in the range from about 10:1 to about 2:3.

3. A process according to claim 2 wherein the weight ratio of reaction medium to cationic surfactant lies in the range from about 2:1 to about 1:1.

4. A process according to claim 2 wherein the organic component is a polyethenoxy condensate of molecular weight greater than about 300.

5. A process according to claim 1 wherein the volatile reactant is a $C_2$–$C_4$ alkylene oxide and the reactants include an acid selected from the group consisting of halo acids, nitric acid, sulphuric acid, oxalic acid, $C_1$–$C_{20}$ aliphatic carboxylic acids, benzoic acid and benzene, toluene, xylene and cumene sulphonic acids.

6. A process according to claim 5 wherein the reaction mixture includes water in an amount of from about 2% to about 10% based on the weight of the organic component.

7. A process according to claim 6 wherein the amount of water is from about 5% to about 10% by weight of the organic component.

8. A process according to claim 1 in which said quaternizing agent has a boiling point at atmospheric pressure less than 100° C. and is present in stoichiometric excess and in which step (b) is carried out to evaporate unreacted quaternizing agent.

9. A process for producing an intimate solid mixture of a nitrogenous cationic surfactant and a water soluble or water dispersible polyethoxylated organic component, said process comprising the steps of (a) forming an intimate mixture of tertiary amine and said organic component;

(b) heating said mixture to a temperature not greater than about 100° C. so as to melt said organic component and provide a liquid mixture;

(c) introducing into said liquid mixture quaternizing agent in an amount representing a stoichiometric excess relative to the tertiary amine and reacting at a temperature of not more than about 100° C. so as to form cationic surfactant while avoiding color body formation;

(d) treating the mixture resulting from step (c) to evaporate unreacted quaternizing agent to leave an intimate mixture of organic component and cationic surfactant wherein the ratio of organic component to cationic surfactant lies in the range from about 10:1 to about 2:3;

(e) cooling to provide intimate solid mixture of cationic surfactant and organic component;

said tertiary amine having a structure selected from the group consisting of (i)

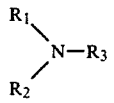

wherein $R_1$ is selected from the group consisting of $C_{12}$–$C_{18}$ alkyl and $C_{10}$–$C_{14}$ alkyl benzyl, $R_2$ is a $C_1$–$C_{20}$ alkyl group and $R_3$ is selected from $C_1$–$C_4$ alkyl and hydroxyalkyl groups, and (ii)

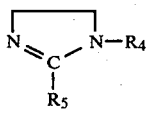

wherein $R_5$ is a $C_1$–$C_{20}$ alkyl group and $R_4$ has the formula

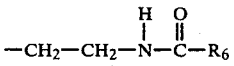

wherein $R_6$ is $C_1$–$C_{18}$ alkyl; said quaternizing agent being selected from the group consisting of $C_1$–$C_4$ alkyl halides; said organic component having a molecular weight greater than about 300 and being selected from the group consisting of $C_{10}$–$C_{20}$ primary or secondary alcohol ethoxylates containing from 4–30 moles of ethylene oxide per mole of alcohol.

10. A process according to claim 9 wherein the tertiary amine is of formula (i) wherein $R_1$ is $C_{12}$–$C_{18}$ alkyl, $R_2$ is $C_1$–$C_{20}$ alkyl and $R_3$ is methyl.

11. A process according to claim 9 wherein the alcohol ethoxylate is a $C_{14}$–$C_{15}$ primary alcohol ethoxylate containing from 7–15 moles of ethylene oxide per mole of alcohol.

12. A process according to claim 9 in which the reaction temperature is not more than about 50° C.

13. A process for producing an intimate solid mixture of a nitrogenous cationic surfactant and a water soluble or water dispersible organic component, comprising the steps of (a) reacting tertiary amine with quaternizing agent in liquid reaction medium consisting essentially of said organic component, said quaternizing agent reactant having a boiling point at atmospheric pressure less than 100° C. and being present in stoichiometric excess, said reaction being carried out at a temperature less than about 50° C. so as to form cationic surfactant in said liquid reaction medium while avoiding color body formation;

(b) treating the mixture resulting from step (a) to evaporate unreacted quaternizing agent to leave intimate mixture of organic component and cationic surfactant wherein the ratio of organic component to cationic surfactant lies in the range from about 50:1 to about 1:2 by weight;

(c) cooling to provide intimate solid mixture of cationic surfactant and organic component;

said tertiary amine being selected from the group consisting of $C_{12}$–$C_{14}$ alkyl dimethyl amines, alkyl benzyl dimethyl amine in which the alkyl group contains from 10 to 14 carbon atoms and di $C_{16}$–$C_{18}$ alkyl methyl amines; said quaternizing agent being selected from the group consisting of methyl chloride, ethyl chloride, methyl bromide and ethylene oxide; said organic component having a molecular weight greater than about 240 and being selected from the group consisting of (i) fatty alcohols containing an average of more than 16 carbon atoms, and (ii) polyethylene oxide condensates of $C_{10}$–$C_{20}$ alcohols, $C_{10}$–$C_{18}$ fatty acids, $C_6$–$C_{12}$ alkyl phenols, and $C_{10}$–$C_{18}$ fatty acid esters of sorbitan.

* * * * *